United States Patent [19]

Brocklehurst et al.

[11] 4,157,692

[45] Jun. 12, 1979

[54] LABEL DISPENSING SYSTEM FOR USE WITH SEWING APPARATUS

[75] Inventors: Charles E. Brocklehurst, Donalds; Perry E. Burton, Fountain Inn, both of S.C.

[73] Assignee: Opelika Manufacturing Corp., Chicago, Ill.

[21] Appl. No.: 771,156

[22] Filed: Feb. 23, 1977

[51] Int. Cl.[2] ..... D05B 97/12; B65H 3/08; B65H 3/22

[52] U.S. Cl. ..... 112/262.3; 271/20; 271/23

[58] Field of Search ..... 271/19, 20, 23, 18.3, 271/99, 161, 165; 112/262, 121.29, 265

[56] References Cited

U.S. PATENT DOCUMENTS

| | | | |
|---|---|---|---|
| 800,086 | 9/1905 | Dixon | 271/19 |
| 1,110,704 | 9/1914 | Minnick | 271/20 |
| 3,582,064 | 6/1971 | Weidman | 271/19 |
| 3,608,891 | 9/1971 | Hannon et al. | 271/23 |
| 3,773,002 | 11/1973 | Burton | 112/262 X |
| 3,877,559 | 4/1975 | Burgin | 271/20 X |

*Primary Examiner*—Peter Nerbun

*Attorney, Agent, or Firm*—Jones, Thomas & Askew

[57] ABSTRACT

The label dispensing system includes an upright label housing which is open at its lower end, a stationary shelf at one side of the opening of the housing for supporting the edge portion of the bottom label in a stack of labels in the housing, a movable platform at the opposite side of the opening of the housing, and pointed instruments movable through slots in the shelf to impale and push the bottom label off the shelf. The platform moves to a level above the shelf to bow the bottom label downwardly as the pointed instruments impale and push the bottom label off the shelf. A suction head is movable from a position immediately beneath the bottom label in the housing through a downward arc to a position above a moving work piece, to grasp and pull the bottom label from the platform and move the bottom label from the stack in the housing to the work piece. A clamp moves down into engagement with the label and moving work piece in timed relationship with the suction head as the suction head releases the label so as to hold the label on the moving work piece as the work piece is folded over about the label to form a hem, and the hem is sewn closed over the label.

25 Claims, 9 Drawing Figures

Fig. 1
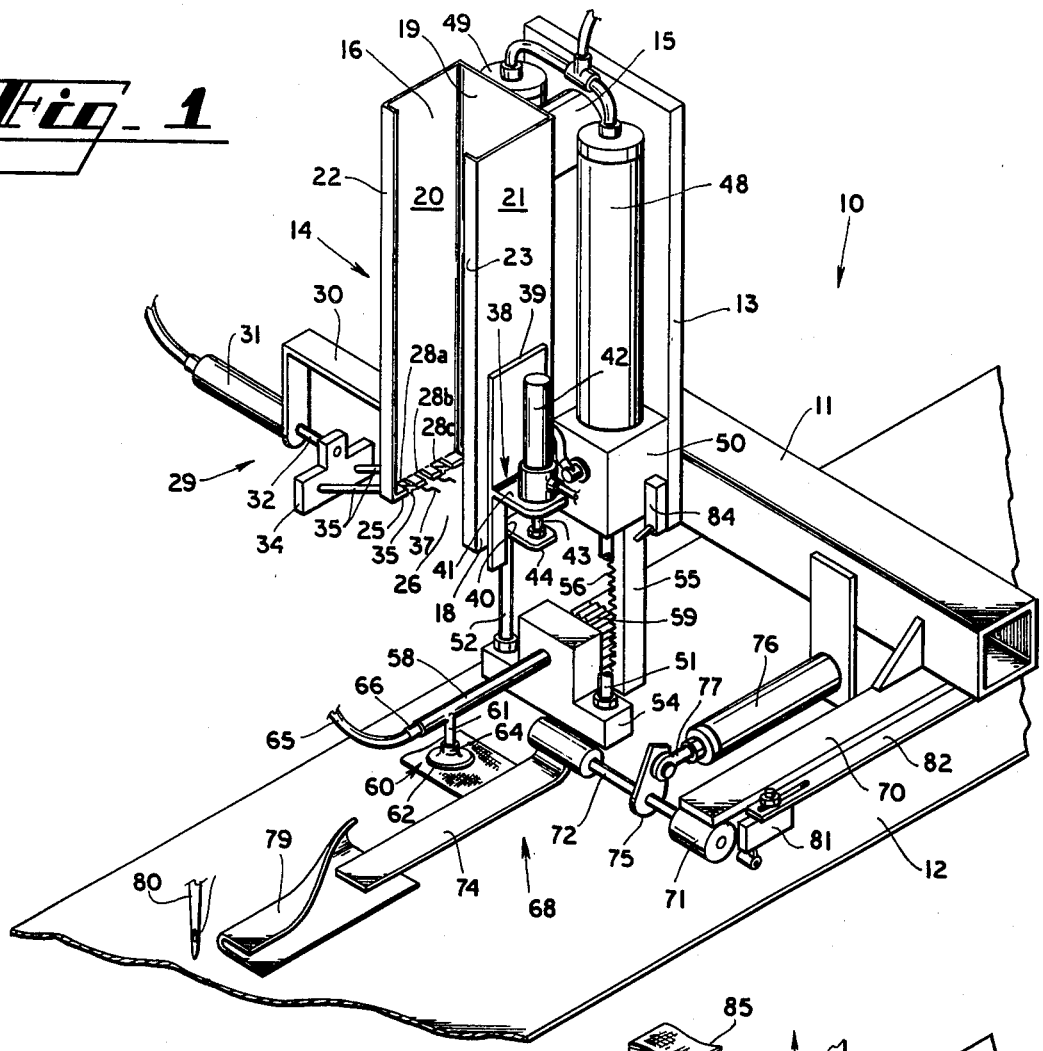
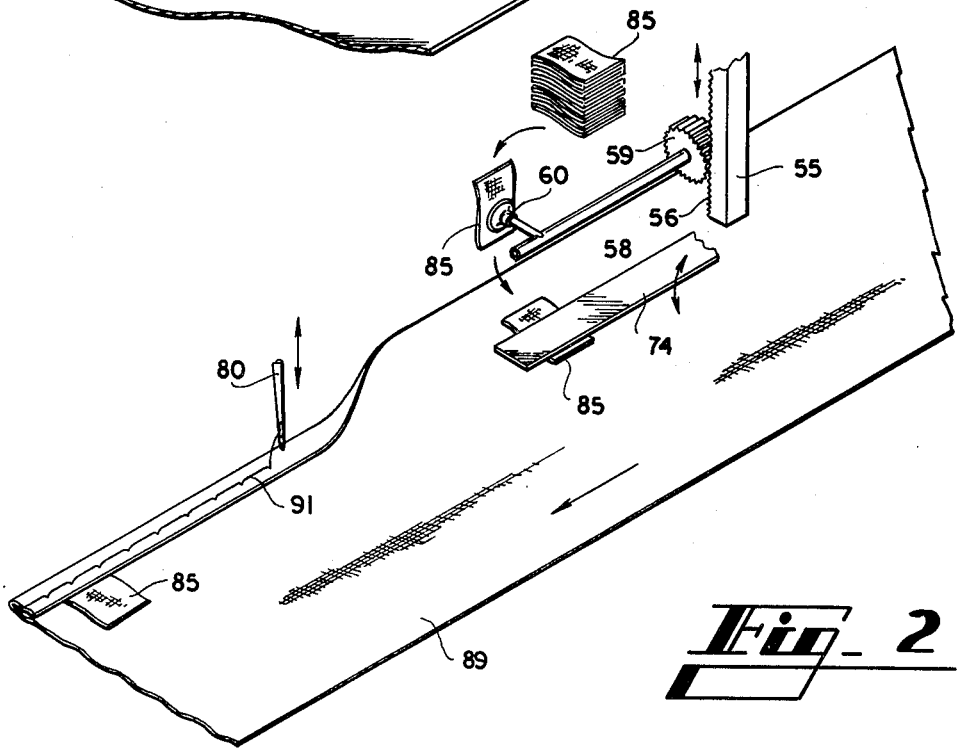
Fig. 2

LABEL DISPENSING SYSTEM FOR USE WITH SEWING APPARATUS

BACKGROUND OF THE INVENTION

This invention relates to a label dispensing system which functions to retrieve the bottom label in a stack of labels and move the label to a moving work piece, such as to moving terry cloth which will be made into towels.

It is customary to insert labels and the like in the hemmed edge of towels and other manufactured products, and to sew the label into the hem. The hem can be folded over the label, or the edge of the product can have an overedge stitch which also attaches the label to the product. In the past, hemmed edges of towels and other products were formed by hand, with a sewing machine operator guiding the edge of the material through a folder and sewing the fold closed. Labels were inserted by the operator into the hem as the hem was being sewn closed. More recently, automatic hemming systems have been developed which hem the edges of sheet material. Examples of such automatic systems are shown in U.S. Pat. Nos. 3,640,235, 3,772,948, 3,773,002 and 3,906,878.

Although the automatic hemming of sheet materials has been accomplished, the placement of labels in the hems of the sheet material is still difficult to accomplish. The label prior art placement systems are not very reliable in that they occasionally fail to dispense labels, the labels which are dispensed sometimes are not properly positioned on the work piece, and sometimes more than one label is dispensed at a time. It appears that one of the shortcomings in the prior art label dispensers is the ability of the dispenser to reliably separate the labels from one another as they are being dispensed from a supply. The threads in the label fabric tend to become somewhat entangled with the threads of an adjacent label, and when the label from the end of a stack is moved away from the stack it tends to cling to the stack or to carry the next label with it. Moreover, when suction devices are used to grip the end label in a stack, the air flow through the label and into the suction device sometimes pulls more than one label from the stack or fails to pull the end label from the stack.

SUMMARY OF THE INVENTION

Briefly described, the present invention comprises a label dispensing system for dispensing labels from a stack of labels and placing the labels on a work piece at an area of the work piece that is to be sewn by a sewing machine, or the like, so that the label can be sewn to the work piece. An edge portion of the bottom label in a vertical stack of labels rests on a stationary shelf, and the opposite edge portion of the bottom label is moved by a movable platform between levels above and below the shelf to allow the edge of the label supported by the movable platform to alternately droop below and then be lifted above the level of the edge portion of the label on the shelf, to bow the center portion of the bottom label downwardly during the dispensing operation. A pointed instrument moves through a slot in the stationary shelf in a direction laterally across the bottom label to impale and push the bottom label off the stationary shelf when the opposite edge of the label on the platform has been lifted and the label is in a bowed configuration. The pushing of the edge portion of the label off the shelf tends to further bow the label downwardly toward a suction head beneath the bottom label, so that the bottom label is then grasped against the suction head by the flow of air through the suction head. The suction head and the label grasped by the suction head then move through a downward arc from a position directly beneath the stack of labels to a position directly over the work piece and adjacent a clamp. As the suction head begins its downward movement the movable platform moves down to relieve the compression on the bottom label so the bottom label can slip off the platform and the suction applied to the label by the suction head is sufficient to hold the label on the suction head as the suction head moves to the work piece. When the work piece is ready for the label, the clamp moves downwardly toward the work piece and traps the label against the work piece as the suction in the suction head is relieved, whereupon the label is applied to and moves with the work piece toward the folder and sewing needle.

Thus, it is an object of this invention to provide a label dispensing system which reliably and accurately dispenses one label at a time to a work piece where the label can be sewn into the work piece.

Another object of this invention is to provide a label dispensing system which functions to bow the bottom label in a vertical stack of labels in a downward direction as the label is being removed from the bottom of the stack where the label can be picked up by a suction head.

Another object of this invention is to provide a label dispensing system that manipulates the end label in a stack of labels so that the end label can be reliably retrieved from the stack of labels without removing additional labels from the stack.

Other objects, features and advantages of the present invention will become apparent upon reading the following specification, when taken in conjunction with the accompanying drawings.

BRIEF DESCRIPTION OF THE DRAWINGS

FIG. 1 is a partial perspective illustration of the label dispensing system.

FIG. 2 is a schematic perspective illustration, similar to FIG. 1, but showing the suction head in an intermediate position.

DETAILED DESCRIPTION

Figure 3:
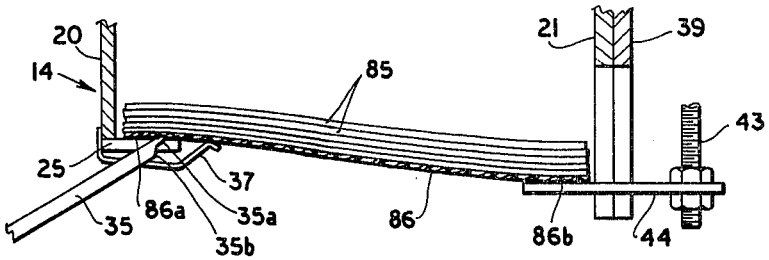
FIGS. 3, 4, 5, 6, 7 and 8 are progressive schematic illustrations of the label dispensing system, showing how the labels are dispensed from the bottom of a stack of labels.
Figure 4:
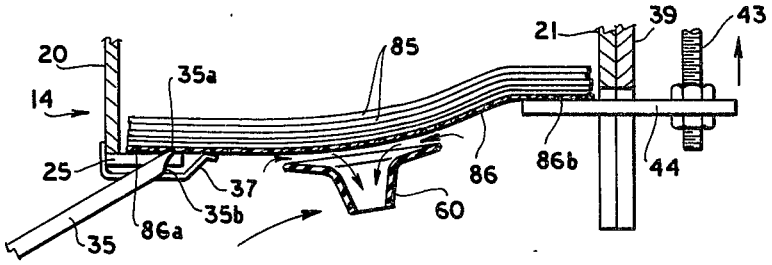
Figure 5:
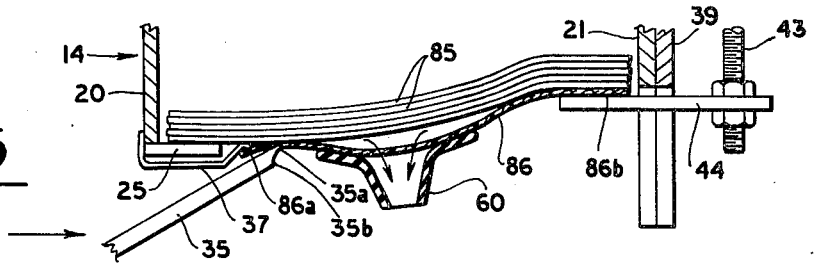
Figure 6:
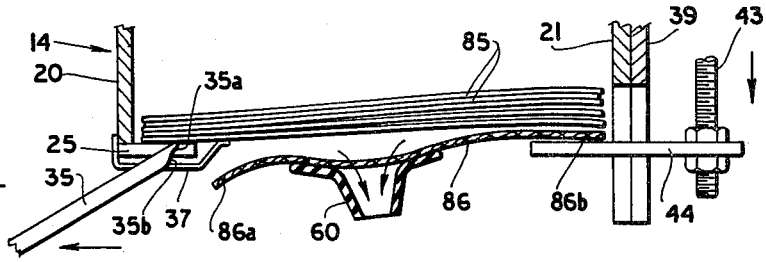
Figure 7:
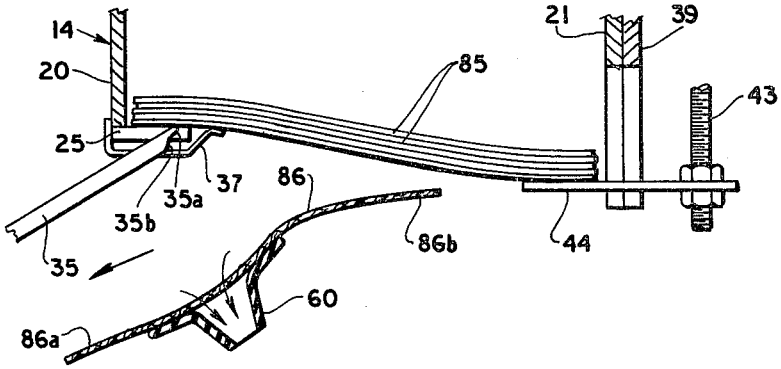
Figure 8:
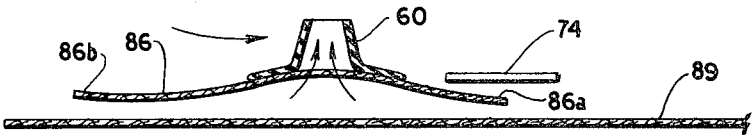

Referring now in more detail to the drawing, wherein like numerals indicate like parts throughout the several views, FIG. 1 illustrates a label dispensing system 10 which includes a horizontally extending support bar 11 that is mounted on the framework of a sewing system or otherwise suspended over a work table 12. Support plate 13 is attached to support bar 11 and extends upwardly therefrom. Label housing 14 is mounted on support plate 13 in spaced relationship therefrom by support bar 15. Label housing 14 is C-shaped in horizontal cross-section and is open at its upper portion 16 and at its lower portion 18. Housing 14 comprises back wall 19, side walls 20 and 21, and front flanges 22 and 23. The front of housing 14 is open so that labels can be easily inserted into the housing in a vertical stack.

A stationary shelf 25 is mounted on the lower edge of side wall 20 and projects inwardly beneath the housing 14 into the lower opening 26 of the housing. Slots or openings 28*a*, 28*b* and 28*c* are formed in stationary shelf 25.

Label pushing means 29 is mounted adjacent the lower portion of side wall 20 by support bracket 30 and includes pneumatic ram 31 and its rod 32, pin support block 34 and at least one pin 35 extending from the pin support block 34. The pins 35 are pointed at their distal ends and protrude through the slots 28*a*, 28*b* and 28*c*. Ram 31 is spring-loaded to its retracted position, and when the ram is actuated by pneumatic pressure, the pin support block 34 and pins 35 move laterally with respect to the lower portions of label housing 14, whereupon the pointed ends of the pins 35 move from the position illustrated in FIG. 1 on further across the lower opening 26 of label housing 14, and when the pneumatic pressure is relieved from the ram 31, the internal spring in the ram housing causes the pin support block 34 and pins 35 to move back to the position illustrated. As shown in FIGS. 3–8, the pointed end portions of pins 35 include pointed ends 35*a* and shoulders 35*b* spaced from the pointed ends to keep the pointed ends from penetrating more than one thickness of the labels.

Deflector wires 37 are attached to side wall 20 of label housing 14 and extend beneath stationary shelf 25 and then are turned upwardly and laterally into the lower opening 26 of the label housing 14. Wires 37 function as a label deflector to guide the labels dislodged from shelf 25 away from the shelf in a manner that will be more fully described hereinafter.

Label lifting means 38 is mounted on side wall 21 of label housing 14 which is across from label pushing means 29. Label lifting means 38 comprises support plate 39 attached to side wall 21 which defines a slot 40 extending upwardly from its lower end, ram support shelf 41 extending horizontally from the support plate and ram 42 with its ramrod 43 mounted on the ram support shelf. Platform 44 is connected to ramrod 43 and extends inwardly through slot 40 and through a mating slot at the lower edge portion 18 of label housing 14. Platform 44 extends into the opening 26 at the lower portion of label housing 14, and the platform is movable vertically between levels below and above the shelf 25.

Suction head assembly 46 is mounted on support plate 13. Suction head assembly 46 includes a pair of pneumatic rams 48 and 49 each mounted on a support block 50 and each including a distendable ramrod 51 and 52. Stationary support blocks 50 are mounted on the support plate 13 and the distendable ramrods 51 and 52 move vertically beneath the support blocks 50. Movable support block 54 is mounted on the ends of ramrods 51 and 52 and is movable vertically with the ramrods. A stationary rack 55 is supported by support plate 13 and includes gear teeth 56. Hollow tube 58 extends horizontally through movable support block 54, and gear 59 is rigidly connected to one end of the tube 58. The teeth of gear 59 mesh with the teeth 56 of the stationary rack 55. Suction head 60 is mounted on hollow stem 61 extending normal to the axis of horizontal tube 58. Suction head 60 includes a flexible suction cup 62 and a hollow stem 64 mounted on stem 61. Pneumatic conduit 65 is connected to hollow tube 58 through swivel joint 66.

When rams 48 and 49 are actuated to move the movable support block 54 vertically, the gear 59 will mesh with the teeth 56 of stationary rack 55, causing hollow tube 58 to rotate as the tube 58 and suction head 60 are moved vertically. This causes suction head 60 to move through an arc beneath label housing 14, from a downwardly facing attitude at a position above work table 12 as illustrated, up to an upwardly facing attitude at a position at lower opening 26 beneath label housing 14.

Clamp means 68 is mounted on support bar 11 and is suspended above work table 12. Clamp means 68 comprises support strap 70 extending from support bar 11, bearing 71 attached to support strap 70, rod 72 rotatably mounted in bearing 71, flexible clamp finger 74 rigidly connected to rod 72, actuator arm 75 rigidly connected to rod 72, and ram 76 with its ramrod 77 connected between actuator arm 75 and support bar 11. When ram 76 is actuated, it oscillates arm 75 and rod 72 in bearing 71 so that clamp finger 74 moves toward and away from engagement with work table 12 and any work product on the work table. Clamp finger 74 can be moved along the length of its rod 72 so as to place the clamp finger adjacent the lower position of suction head 60 and adjacent a stationary hem folder 79 on work table 12. The needle 80 of a sewing machine (not shown) is located adjacent the stationary folder 79.

Actuating or label placement switch 81 is mounted on a support strap 82 which is suspended from the support bar 11, and the switch 81 is positioned just above the surface of work table 12 so that a work product can be moved between the work table and switch 81 and the switch 81 will detect the contours of the surface of the work product, and will open and close in response to changes in the height of the contours of the work product. Upper limit switch 84 is mounted on the support block 50 above the movable support block 54 of the suction head assembly 46 so as to detect the movement of the support block 54 to its up position.

As illustrated in FIGS. 3–8, labels 85 are formed in a vertical stack in label housing 14, with the bottom or lowermost label 86 resting supported at one edge portion 86*a* on shelf 25 and its other edge portion 86*b* on platform 44. Thus, all of the labels 85 in the stack are supported by shelf 25 and platform 44. When the system is at rest, a flow of air is continuously induced through suction head 60 and the suction head 60 is at its lowermost position as illustrated in FIG. 1. A label will have been dispensed from label housing 14 and will be grasped by the suction head 60 and maintained over the work table 12 adjacent clamp finger 74. When actuator switch 81 detects a variation in the height of the work piece moving across work table 12, the label dispensing system is energized and performs its functions in the following sequence.

The suction through suction head 60 is momentarily interrupted so that the label in the suction head is released, and simultaneously the clamp finger 74 is oscillated down toward engagement with work table 12 by the distention of ram 76. The interruption of the airflow through suction head 60 is momentary so that the flow of air through suction head 60 is resumed. In the meantime, the label dispensed to the work table is pressed into engagement with the moving work piece 89 and carried with the work piece beneath the clamp finger to folder 79 and sewing machine needle 80, where the edge 90 of the work piece 89 is folded over an end of the label so that the label is inserted in the folded hem 91, and the sewing machine needle 80 sews the label in the hem.

Hydraulic rams 48 and 49 are also actuated by actuator switch 81 so as to lift movable support block 54. As the movable support block 54 is lifted, gear 59 meshes with the teeth 56 of stationary rack 55, causing suction head 60 to pivot about hollow tube 58, and thereby move in an upward arc from its position adjacent work table 12 to a position beneath label housing 14. In the meantime, actuator switch 81 will have also actuated ram 42 of label lifting means 38, causing platform 44 to move upwardly from its rest position (FIG. 3) and lift an edge of the bottom label 86 in the stack of labels 85 to a level higher than the shelf 25 (FIG. 4), thereby bowing the middle portion 86*c* of the bottom label 86 downwardly. As the suction head 60 reaches its up position beneath the stack of labels (FIG. 4) the movable support block 54 engages the upper limit switch 84.

Upper limit switch 84 actuates ram 31 and causes pin support block 34 and pins 35 to move toward the opening 26 at the bottom of label housing 14, whereupon the pointed ends of pins 35 engage and impale the bottom label 86 and push the bottom label 86 (FIG. 5) until the edge 86*a* of the bottom label 86 is moved off shelf 25. The actuation of ram 31 of label pushing means 29 is only momentary and the pins 35 retract to their original positions (FIG. 6) after the label has been pushed off the platform 25.

As the bottom label 86 is pushed off the platform 25, the previously induced downward bow or bend in the label tends to cause the label to "break" or further bow in a downward direction. The increased bowed configuration of the bottom label 86 causes the lower surface of the label to move further toward suction head 60, and the flow of air induced through the suction head 60 causes the bottom label 86 to be grasped by the suction head 60.

When the pins 35 push the edge portion 86*a* of the bottom label 86 off the shelf 25, the edge portion 86*a* of the bottom label moves beyond the deflector wires 37, and when the pins 35 are moved back to their retracted positions and release the bottom label 86, the edge portion 86*a* of the bottom label will be deflected downwardly by the deflector wires 37 away from shelf 25. This prevents the bottom label from reentering any space that might be left between the shelf 25 and the label next above the bottom label 86, and keeps the edge portion 86*a* of the bottom label from wedging up against the vertical surface of the shelf 25.

The upper limit switch 84 also deenergizes the ram 42 of label lifting means 38 and reverses rams 48 and 49 so as to push the movable support block 54 and suction head assembly 46 back in a downward direction toward the work table 12. As the suction head 60 begins its downward arcuate movement, the downward movement of the platform 44 tends to relieve the frictional clamping effect of the stack of labels downwardly against the edge portion 86*b* of the bottom label 86, so that the bottom label can be slipped off the platform 44. The movement of the suction head 60 is in a counterclockwise direction (FIG. 7) and away from the movable platform 44, and the suction head 60 continues to move through its downward arc until it resumes its static position above the work piece 89 with a label grasped by the suction head and located just above the work piece 89.

Figure 9:
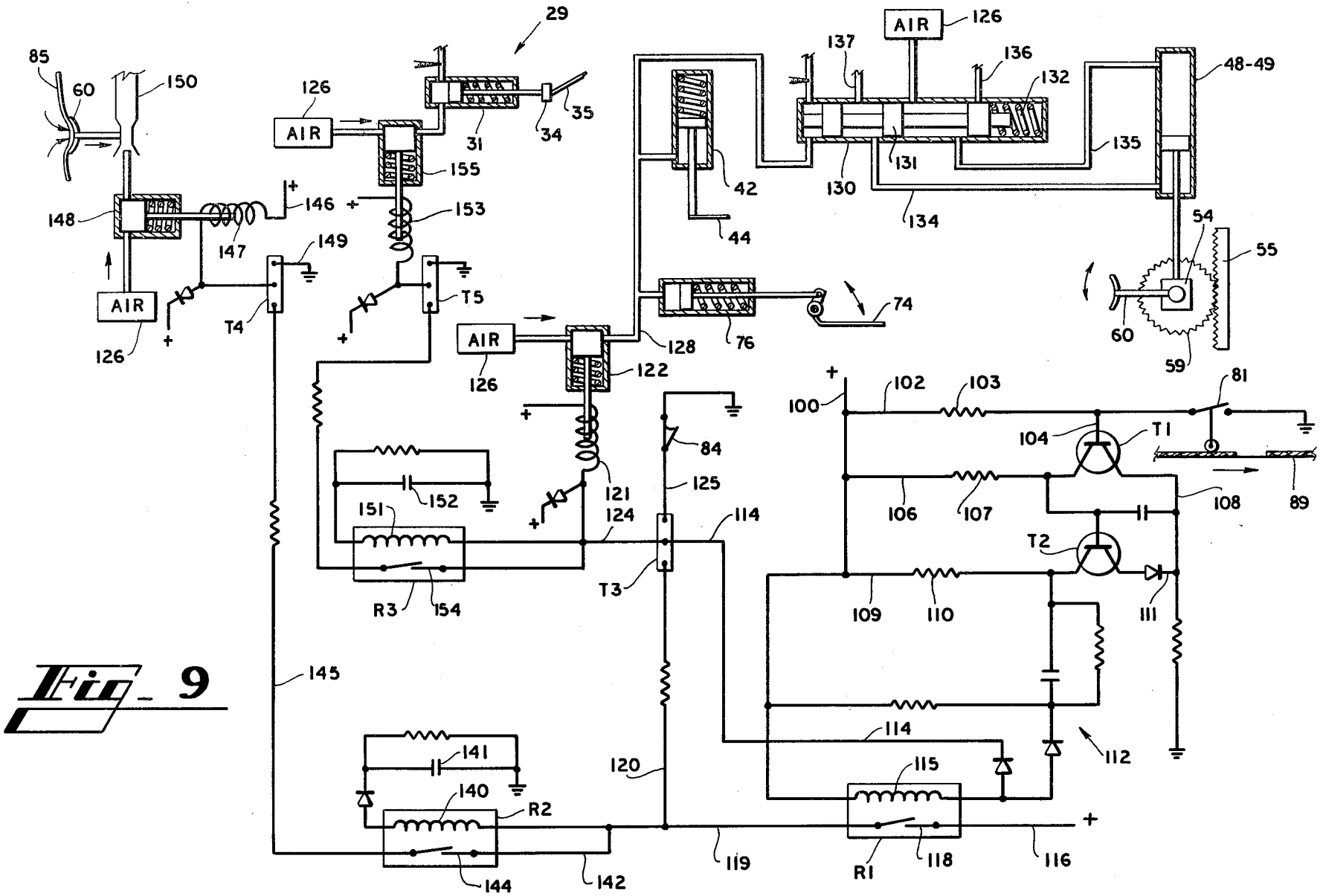
FIG. 9 is an electrical and mechanical diagram of the control system for the label dispensing system.

As illustrated in FIG. 9, the electrical and mechanical control circuitry for the label dispensing system comprises a source of positive current to conductor 100 which is connected through conductor 102 and its resistance 103 to the base 104 of transistor T1, and through label placement switch 81 to negative. Thus, transistor T1 is normally biased on until the label placement switch 81 is closed by the break in contour of the work product 89 being moved through the sewing station, whereupon the transistor is cut off. Conductor 106 is connected to transistor T1 through resistor 107, to conductor 108 to ground. Transistor T2 is connected to conductor 100 through conductor 109 and its resistance 110, and through conductor 111 to conductor 108 and ground. When label placement switch 81 is open and transistor T1 is on, the base of transistor T2 is shunted through transistor T1 and transistor T2 is therefore off. When transistor T1 is off, transistor T2 is pulsed on.

When transistor T2 is pulsed on, it energizes latching relay R1 through circuit 112. The conductor 114 leading from the coil 115 of the latching relay R1 is connected to transistor T3. A positive signal passes from conductor 116 through the now closed switch 118 of latching relay R1 and through conductors 119 and 120 to the base of transistor T3. When transistor T3 is energized, a holding circuit is made from conductor 100 through the coil 115 of latching relay R1 through conductor 114 through upper limit switch 84 to ground.

When the holding circuit has been energized, a circuit is made from positive through the coil 121 of solenoid air valve 122, through conductor 124, through transistor T3, through conductor 125, upper limit switch 84, to ground. Air valve 122 is a normally closed valve which controls the flow of air from air source 126 through air conduits 128 to clamp finger ram 76, to label lifting ram 42 and to pilot valve 130 of suction head rams 48 and 49.

The air pressure causes the clamp finger 74 to move down into engagement with the label on the moving work piece and the movable platform 44 to move upwardly and to lift an edge portion of the bottom label in the stack of labels. Also, the air pressure causes the spool 131 of the pilot valve to shift against the bias of its compression spring 132, so that the air source 126 communicates with conduit 134 to the lower ends of suction head rams 48 and 49, while allowing the conduit 135 to vent to exhaust port 136, so that the rams 48 and 49 retract and lift the suction head.

When the contacts 118 of latch relay R1 close, a circuit is made from a positive source through conductor 116, contacts 118 through conductor 119 to relay R2. The current passing through the coil 140 of relay R2 charges capacitor 141, which causes the relay contacts 144 to pulse. The normally open contacts of the relay R2 therefore close momentarily. Conductor 119 is connected to conductor 142 through normally open contacts 144 of relay R2, and the contacts 144 are connected to conductor 145 to transistor T4. The positive signal received by transistor T4 allows the transistor to fire from a positive input to conductor 146, through the coil 147 of solenoid air valve 148, through the transistor T4, and then through the conductor 149 to negative. Since the contacts 144 of relay R2 are closed only momentarily, the normally open air valve 148 will close momentarily. Air valve 148 controls the flow of air from air source 126 through a venturi 150, and venturi 150 communicates with suction head 160 and induces a flow of air into the suction head. Thus, the pulsing of relay R2 temporarily interrupts the flow of air induced through suction head 60 to cause the suction head to drop its label. Relay R2 will not pulse again until relay R1 has opened and closed again.

When movable support block 54 and suction head 60 reach their uppermost positions, limit switch 84 is opened, which opens the circuit through conductor 125 from transistor T3. When limit switch 84 is opened, a pulse of positive current passes through the coil 151 of relay R3 to charge capacitor 152, whereupon the contacts 154 of relay R3 are momentarily closed to bias transistor T5. After the capacitor has been charged, the contacts 154 of relay R3 are opened and the holding circuit to latch relay R1 is opened. In the meantime, the pulse to transistor T5 momentarily closes a circuit through solenoid 153 which momentarily opens the normally closed valve 155 so that the source of air 126 actuates label pushing ram 31 to move the pins 35 laterally across the bottom label in the stack of labels and to push the bottom label off the shelf 25. Since the signal to the normally closed air valve 155 is only momentary, the valve 155 closes and the ram 31 retracts.

When the limit switch 84 has been opened and when the relay R3 has pulsed, the signal is lost to the normally closed air valve 122, and the valve 122 closes, cutting off the flow of air to clamp finger ram 76, to label lifting ram 42, and to pilot valve 130, whereupon the clamp finger is lifted, the labels are lowered, and pilot valve 130 is shifted under the influence of its coil compression spring 132. The source of air that had been communicating through air conduit 134 to lift the suction head 60 now communicates through air conduit 135 to lower the suction head, and the air beneath the pistons of the rams 48 and 49 is exhausted back through air conduit 134 and through exhaust port 137. When the suction head 60 reaches its lowermost position, it holds the label above the work product until the label placement switch 81 is closed again to repeat the cycle.

The label placement switch has been described as a micro switch which detects a change in height of the work piece to start the label dispensing cycle; however, other actuator means can be used, if desired. For example, a photo electric cell or yardage meter can be used to start the dispensing cycle. Moreover, the pins 35 have been disclosed as moving across the bottom of the stationary labels; however, other types and shapes of label pushing means can be used to remove the bottom label from the stack and the stack can move laterally across the pins, if desired. Furthermore, while this invention has been described in detail with particular reference to a preferred embodiment thereof, it will be understood that variations and modifications can be effected within the spirit and scope of the invention as described hereinbefore and as defined in the appended claims.

We claim:

1. A method of dispensing labels and the like from the bottom of a vertical stack of labels comprising supporting a first edge of the bottom label and the stack of labels on a shelf, lifting the opposite edge of the bottom label, pushing the bottom label in a lateral direction until the first edge of the bottom label moves off the shelf, lowering the opposite edge of the bottom label, removing the bottom label from the stack and moving the removed label away from the stack.

2. The method of claim 1 and wherein the step of pushing the bottom label in a lateral direction comprises impaling the bottom label with a pointed instrument and moving the instrument laterally with respect to the bottom label until the first edge of the label is moved off the shelf, and then moving the pointed instrument in the opposite lateral direction until the label is no longer impaled by the pointed instrument, and deflecting the first edge of the label away from the shelf as the pointed instrument moves in the opposite lateral direction.

3. The method of claim 1 and further including the step of lowering the opposite edge of the bottom label after the first edge of the bottom label has been pushed off the shelf and as the label is being removed from the stack.

4. The method of claim 1 and wherein the step of removing the bottom label from the stack comprises applying suction to the bottom label as the bottom label is pushed off the shelf and wherein the step of moving the removed label away from the stack comprises moving the removed label in a downward arc with its first edge leading its second edge.

5. A method of dispensing labels or other flat objects from the end of a stack of labels comprising supporting the end label in the stack of labels at one edge of the end label on a shelf, and supporting the end label in the stack of labels at its opposite edge on a platform, pushing the end label in a first direction laterally off the shelf while maintaining the opposite edge portion of the end label on the platform so as to bow the end label outwardly from the stack, gripping the label, at least partially relieving the support of the end label in the stack of labels at its opposite edge on the platform, and pulling the label in a direction generally opposite to the first direction laterally from the stack off the platform.

6. The method of claim 5 and wherein the step of pushing the end label in a first direction laterally off the shelf comprises moving a pointed instrument and the stack of labels with respect to each other so that the pointed instrument impales the end label and pulls the edge of the end label off the shelf.

7. The method of claim 5 and further including bowing the end label outwardly away from the stack prior to pushing the end label off the shelf.

8. A method of dispensing labels and the like comprising arranging the labels in a vertical stack with one edge of the bottom label in the stack resting on a shelf and the opposite edge of the bottom label resting on a movable platform, moving the movable platform from a level below the shelf to a level above the shelf, moving at least one pointed instrument laterally with respect to the bottom label and impaling the bottom label with the pointed instrument and moving the instrument laterally across the bottom of the stack of labels to push the edge of the bottom label off the shelf and bow the bottom label further toward contact with a suction head so that the bottom label is gripped by the suction head, moving the movable platform from a level above the level of the shelf to a level below the shelf, and moving the suction head and the label gripped by the suction head in a downward arc in a direction away from the platform.

9. The method of claim 8 and wherein the steps of impaling the bottom label with a pointed instrument and moving the instrument laterally across the bottom of the stack of labels is followed by the steps of moving the pointed instrument in the opposite direction to withdraw the pointed instrument from the label and deflecting the edge of the bottom label away from the shelf.

10. The method of claim 8 and wherein the step of moving the suction head and the label gripped by the suction head in a downward arc comprises moving the label gripped by the suction head toward a moving work piece, discharging the label onto the moving work piece, holding the label on the moving work piece, and sewing through the label and moving work piece.

11. The method of claim 8 and further comprising inducing a flow of air into the suction head and interrupting the flow of air into the suction head when the suction head has moved in a downward arc away from the stack of labels to release the label gripped by the suction head.

12. A method of placing labels and the like on a work piece comprising inducing a flow of air through a suction head with a label supported by the suction of the air flow through the suction head at a position over the work piece, interrupting the flow of air through the suction head to discharge the label onto the work piece, holding the label on the work piece, attaching the label to the work piece, moving the suction head through an upward arc away from the work piece toward the bottom of a stack of labels, bowing the bottom label in the stack downwardly away from the stack toward the suction head so that the flow of air induced through the suction head holds the bottom label against the suction head, and moving the suction head through a downward arc away from the stack of labels toward the work piece.

13. The method of claim 12 and wherein the step of bowing the bottom label in the stack of labels comprises impaling the bottom label with a pointed instrument and moving the instrument with respect to the labels laterally across the bottom label.

14. In a process of dispensing labels from the bottom of a stack of labels, the steps of supporting the bottom label in the stack at a first edge of the label on a shelf, lifting a second edge of the label which is opposite to the first edge of the label from a level below the shelf to a level above the shelf to bow the central portion of the bottom label downwardly, pushing the bottom label laterally until the first edge of the bottom label moves off the shelf, deflecting the first edge of the bottom label away from the shelf, lowering the second edge of the bottom label, and withdrawing the bottom label from the stack.

15. The process of claim 14 and wherein the step of withdrawing the bottom label from the stack comprises moving the bottom label in a lateral direction from beneath the stack of labels after the second edge of the bottom label begins to move downwardly.

16. Apparatus for applying labels and the like to a work piece comprising a housing for holding a stack of labels, said housing defining an opening at its lower end, a shelf at one end of the lower portion of said housing for supporting a first edge portion of the bottom label in a stack of labels in said housing, a platform on the side of the housing opposite to said shelf for supporting a second edge portion of the bottom label in a stack of labels in said housing, means for raising and lowering said platform, and label pushing means positioned at the lower portion of said housing for pushing the bottom label off said shelf.

17. The apparatus of claim 16 and further including label deflecting means adjacent said shelf for deflecting the bottom label which has been pushed off said shelf away from said shelf.

18. The apparatus of claim 16 and wherein said platform is movable from a level below said shelf to a level above said shelf.

19. The apparatus of claim 16 and wherein said label pushing means comprises a pointed instrument movable with respect to the bottom label laterally across the bottom label.

20. The apparatus of claim 16 and further including a suction head movable through an arcuate path below said housing between and upwardly facing attitude beneath said housing for grasping the bottom label in a stack of labels in said housing and a downwardly facing attitude further below said housing for placing the label adjacent a work piece.

21. The apparatus of claim 16 and wherein said shelf defines slots therein, and wherein said label pushing means comprises pointed instruments movable through said slots to impale the bottom label.

22. The apparatus of claim 16 and wherein the housing adjacent said platform extends to a level below the lowermost position of said platform.

23. Apparatus for applying labels and the like to a work piece comprising shelf means for supporting the bottom label in a stack of labels at a first edge of the bottom label, means for raising and lowering a second edge of the bottom label in the stack of labels between a level below the shelf means and a level above the shelf means, and means for moving the bottom label laterally until the first edge of the bottom label moves off said shelf means when the second edge of the bottom label is at a level above said shelf means.

24. The apparatus of claim 23 and wherein said means for moving the bottom label laterally comprises a pointed instrument and means for moving the pointed instrument into engagement with the bottom label and laterlly across the bottom label.

25. A method of dispensing labels or other flat objects from the end of a stack of labels comprising supporting the stack of labels on a stationary shelf at a first edge of the end label and on a movable platform at the edge of the end label which is opposite to its first edge, pushing the end label laterally off the stationary shelf while maintaining the opposite edge portion of the end label on the platform, moving the movable platform to bow the end label out away from the stack, gripping the end label, at least partially relieving the support of the end label in the stack of labels at its opposite edge on the platform and pulling the end label laterally from the stack off the platform.

* * * * *